US006129204A

United States Patent [19]

Owen et al.

[11] Patent Number: 6,129,204

[45] Date of Patent: Oct. 10, 2000

[54] MACHINE FOR ASYNCHRONOUSLY OPERATING DUAL INDEXING CONVEYORS

[75] Inventors: Barry C. Owen, Troy; John A. Weber, Webberville; Timothy H. Drury, Howell; Kenneth P. McDonald, Wixom, all of Mich.

[73] Assignee: Elopak Systems AG, Glattbrugg, Switzerland

[21] Appl. No.: 09/102,782

[22] Filed: Jun. 23, 1998

[51] Int. Cl.[7] ..... B65G 23/00

[52] U.S. Cl. ..... 198/832.1; 198/570; 198/604; 198/626.1; 198/741

[58] Field of Search ..... 198/832.1, 741, 198/626.1, 604, 570, 575, 577

[56] References Cited

U.S. PATENT DOCUMENTS

| | | | |
|---|---|---|---|
| 2,628,010 | 2/1953 | Ray et al. . | |
| 2,857,787 | 10/1958 | Natalis . | |
| 4,354,086 | 10/1982 | Opprecht . | |
| 4,364,468 | 12/1982 | Hetra, Jr. et al. | 198/575 |
| 4,582,192 | 4/1986 | Rojlar | 198/575 |
| 4,640,408 | 2/1987 | Eaves | 198/577 |
| 4,790,123 | 12/1988 | Ljungstrom et al. . | |
| 5,303,809 | 4/1994 | Zeller | 198/832.1 |
| 6,039,092 | 3/2000 | Muscara | 198/832.1 |

*Primary Examiner*—Christopher P. Ellis
*Assistant Examiner*—Khoi H. Tran
*Attorney, Agent, or Firm*—Reising, Ethington, Barnes, Kisselle, Learman & McCulloch, P.C.

[57] ABSTRACT

A machine including a single power source for asynchronously operating dual indexing conveyors. The single power source is a reversible servo unit operatively connected to gear sets and one-way clutches to drive the conveyors. Alternately, the power source is a uni-directional rotating driver with linkage means to reciprocally move a rack operatively connected to gear sets with one-way clutches or ratchets and pawls.

21 Claims, 2 Drawing Sheets

MACHINE FOR ASYNCHRONOUSLY OPERATING DUAL INDEXING CONVEYORS

TECHNICAL FIELD

This invention relates generally to indexing conveyors, and, more particularly, to a machine including a single power source arrangement for asynchronously operating dual indexing conveyors.

BACKGROUND ART

Ray et al U.S. Pat. No. 2,628,010 discloses a machine for alternately moving a pair of conveyors, including an air cylinder for alternately actuating a pair of ratchets adapted to rotate respective shafts each carrying a gear operatively connected to a series of gears and further shafts carrying the end sprockets for engagement with the chains of the pair of conveyors.

Natalis U.S. Pat. No. 2,857,787 discloses a common drive mechanism for a pair of asynchronously intermittent, rotating turrets, wherein a portion of the kinetic energy of one turret undergoing deceleration is transferred to the other turret undergoing acceleration. A drive shaft is connected to the two turrets by a pair of cams. A motor is connected to a first speed reduction unit which, in turn, is connected to a second worm gear speed reduction unit, the output of which is connected by a chain to the drive shaft.

Oprecht U.S. Pat. No. 4,354,086 discloses a drive motor driving two separate cam drive gears for driving first and second transport devices via respective sprocket wheels.

Ljungstrom et al U.S. Pat. No. 4,790,123 discloses a method and machine for driving a pair of conveyors asynchronously. The machine includes a motor, an indexing gear box operatively connected to the motor to convert the continuous rotation of the motor to an indexing movement and to transfer the movement to a driving shaft located centrally in the machine and which, in turn, drives two parallel conveyors.

DISCLOSURE OF THE INVENTION

A general object of the invention is to provide an improved machine for driving a pair of conveyors asynchronously.

Another object of the invention is to provide an improved machine for asynchronously driving a pair of conveyors from a single power source.

A further object of the invention is to provide controlled motion, as is required for moving a liquid filled container while its top is open.

A further object of the invention is to provide a machine including an intermittently actuating single power source operatively connected to two sets of gears, each having a one-way clutch connected thereto, and being mounted on shafts which asynchronously drive a pair of indexing conveyors carrying open-topped cartons through filling and top forming and sealing steps.

A still further object of the invention is to provide such a machine wherein the power source is one of (1) a reversible servo unit having a gear thereon for meshing with one gear of each gear set, and (2) a uni-directional rotating driver with linkage means connected from the driver to reciprocally move a rack connected to a gear of each gear set.

These and other objects and advantages will become more apparent when reference is made to the following drawings and the accompanying description.

BEST MODE FOR CARRYING OUT THE INVENTION

Figure 1:
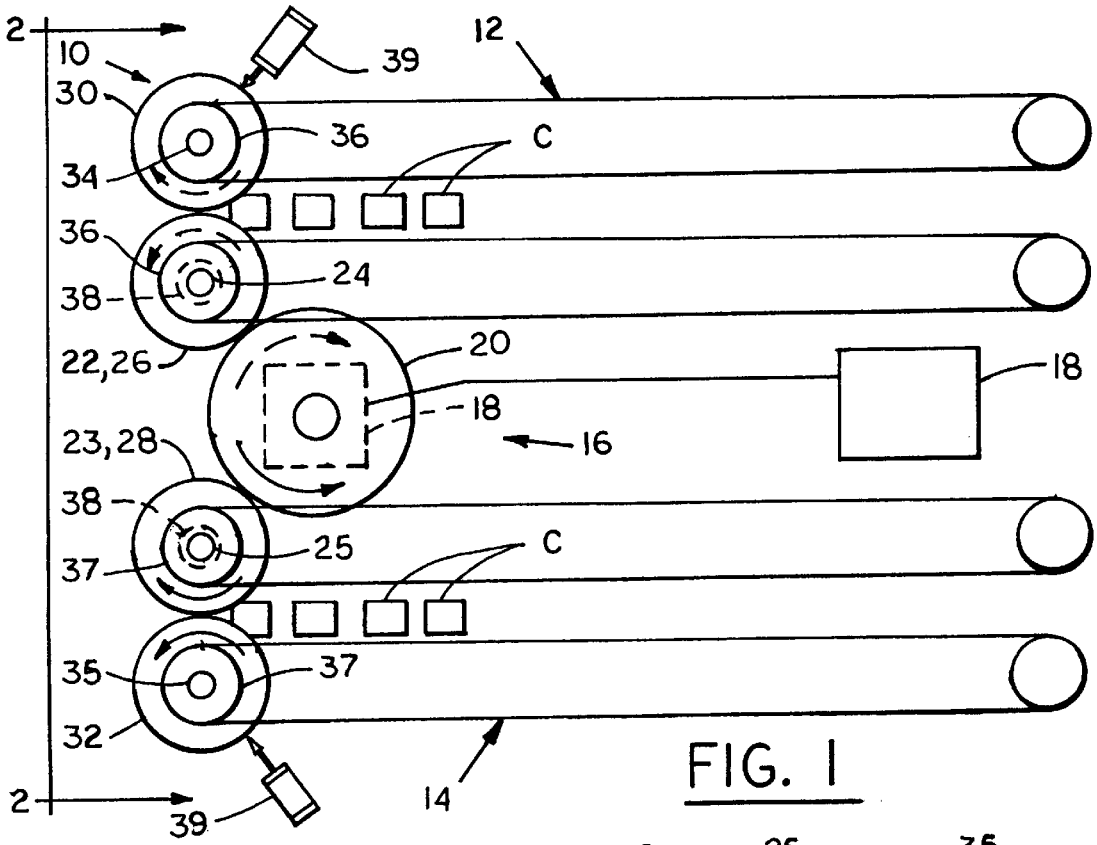
FIG. 1 is a top view of a machine embodying the invention.
Figure 2A:
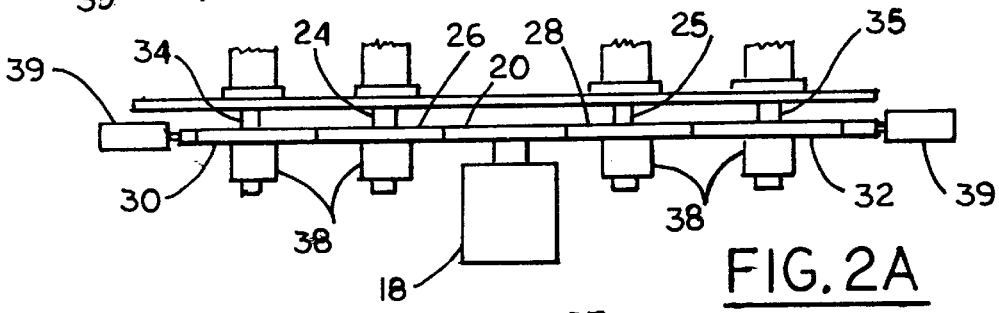
FIG. 2A is a fragmentary end view of an alternate embodiment of the FIG. 2 structure.
Figure 2:
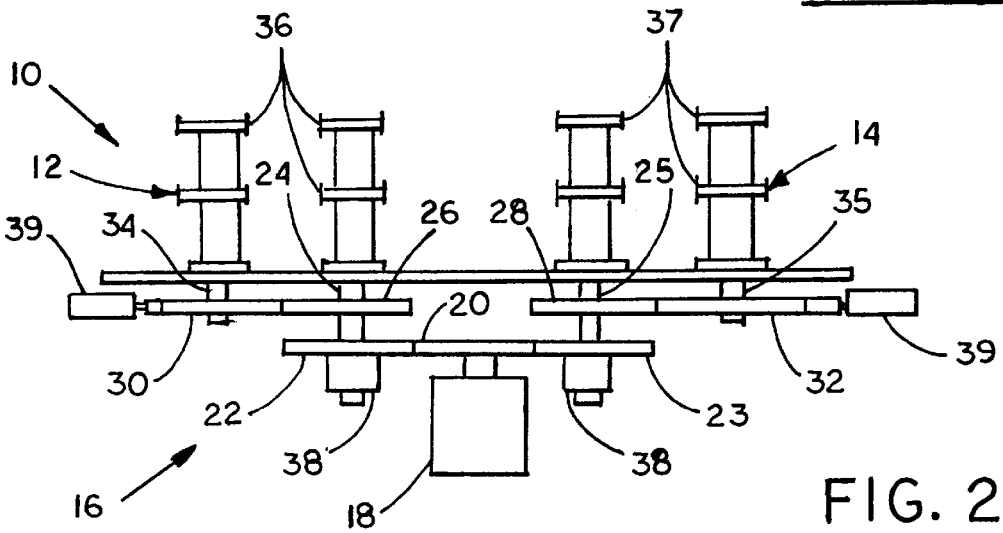
FIG. 2 is an end view taken along the plane of the line 2—2 of FIG. 1, and looking in the direction of the arrows.

Referring now to the drawings in greater detail, FIGS. 1 and 2 illustrate a carton processing machine 10 including (1) a pair of side-by-side indexing conveyors 12 and 14 adapted to receive and convey open-topped cartons, represented as C, for further processing on forming, filling and sealing machines (not shown); and (2) an apparatus 16 adapted to asynchronously drive the indexing conveyors 12 and 14 during the carton filling and top folding and sealing operations.

The apparatus 16 includes a reversible servo unit 18 driving a gear 20 which meshes with two gears 22 and 23 mounted on respective shafts 24 and 25. Gears 26 and 28 are also mounted on the respective shafts 24 and 25 (FIG. 2). The gears 26 and 28 mesh with respective further gears 30 and 32 mounted on respective shafts 34 and 35. The shafts 24/34 and 25/35 rotate respective pulleys or sprockets 36 and 37 for driving two sides of each respective conveyor 12 and 14. A one-way clutch 38 is operatively connected to each of the respective gears 22 and 23 and their respective associated shafts 24 and 25, to asynchronously drive the conveyors 12 and 14 via the shafts 24/34 and 25/35 in one direction, depending upon the direction of rotation of the reversible servo unit 18.

A suitable optional holding device 39 may be operatively connected to each of the respective gears 30 and 32 to maintain respective dwell or stop positions of the conveyors 12 and 14.

As an alternate arrangement, the machine 10 may encompass having the gear 20 mesh directly with each of the gears 26 and 28, as shown in FIG. 2A, with a clutch 38 operatively connected to each of the gears 26, 34, 28 and 32 and their respective shafts.

A servo unit, such as the reversible servo unit 18, typically may be variably accelerated and decelerated by virtue of an associated reversible servo unit controller, represented as 18' in FIG. 1, programmed to use a parabolic curve or cam emulation. As such, the approach toward and departure from each dwell or stop position of the respective conveyors 12 and 14 assumes a controlled motion, serving to minimize "slosh" of the product within liquid-carrying cartons C during the intermittent conveying thereof.

Figure 3:
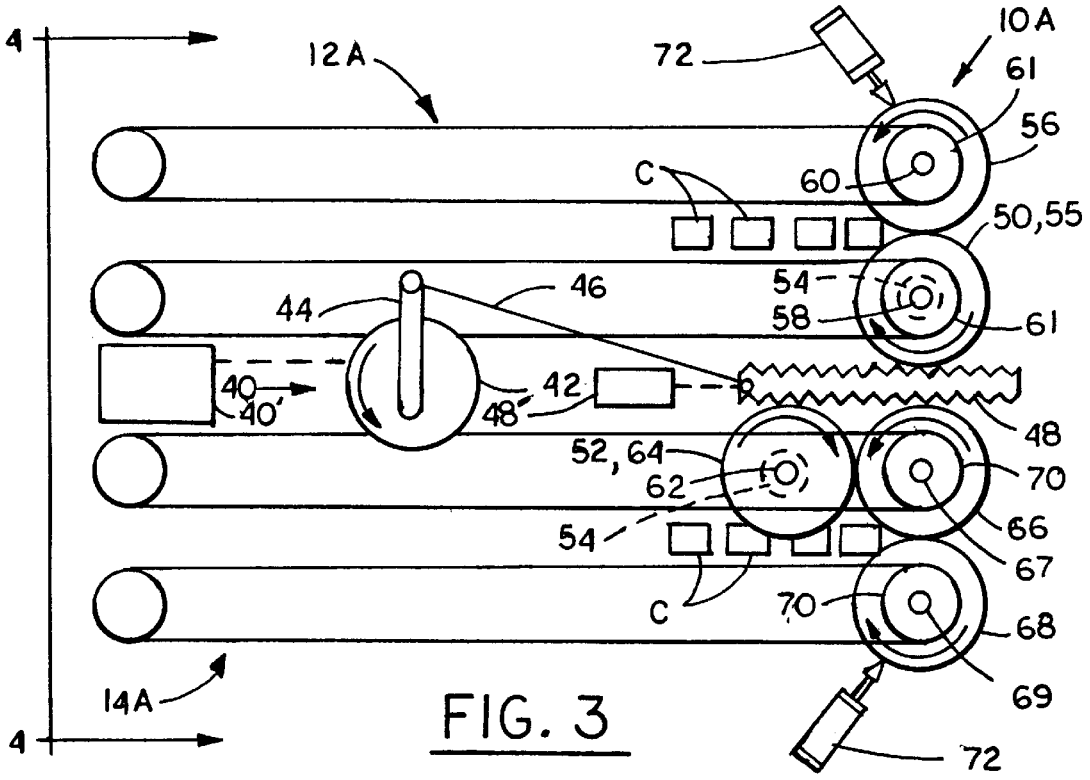
FIG. 3 is a top view of a machine embodying an alternate embodiment of the invention.
Figure 4A:
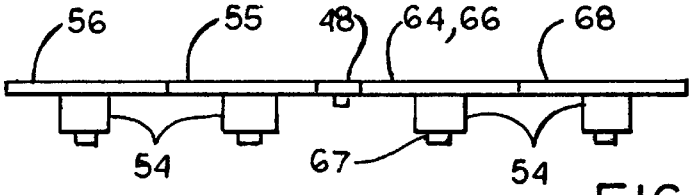
FIG. 4A is a fragmentary end view of an alternate embodiment of the FIG. 4 structure.
Figure 4:
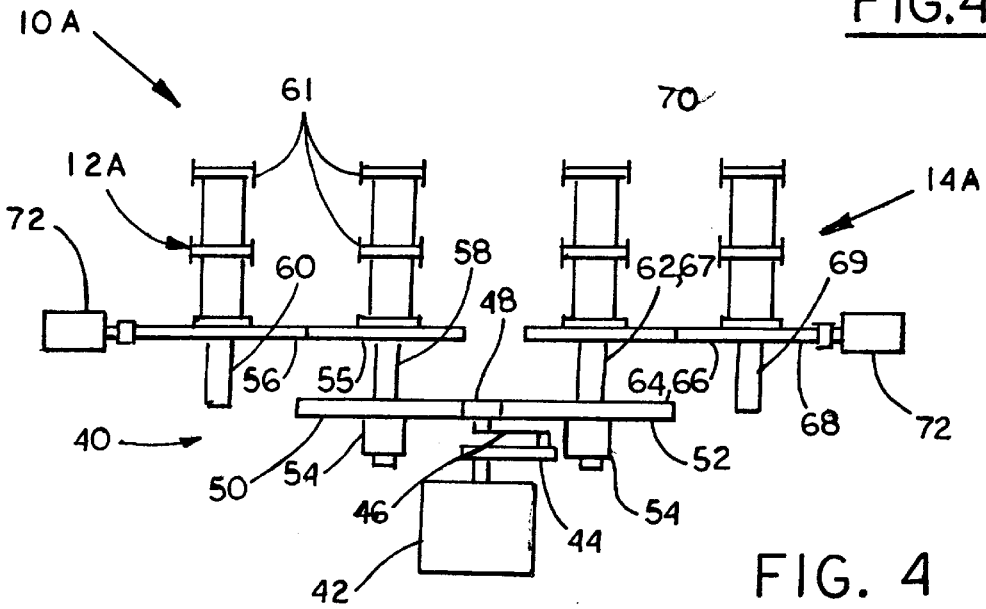
FIG. 4 is an end view taken along the plane of the line 4—4 of FIG. 3, and looking in the direction of the arrows.

Referring now to FIGS. 3 and 4, there is illustrated an alternate embodiment of a carton processing machine 10A. The machine 10A includes (1) the pair of side-by-side indexing conveyors 12A and 14A, also adapted to receive and convey open-topped cartons C; and (2) an apparatus 40 adapted to asynchronously drive the indexing conveyors 12A and 14A during the further processing operations of the cartons.

The apparatus 40 includes a uni-directional rotating driver unit 42, which may be electrical, such as a step motor or a servo motor, or mechanical, such as a cam, a geneva mechanism or an indexer. A crank arm 44 is connected to the driver unit 42 for rotation therewith. A link arm 46 is pivotally connected between the distal end of the crank arm 44 and a two-sided toothed rack 48, adapted to move the crank arm longitudinally back and forth. The toothed rack 48 meshes at one side thereof with a gear 50 and at the other side thereof with a gear 52. A one-way clutch or a ratchet and pawl, represented as 54, is operatively connected to each gear 50 and 52.

Where the apparatus 40 is electrical, such as a servo motor or a step motor, a servo controller, represented as 40', is programmed to use a parabolic curve or cam emulation to control acceleration and deceleration, and, thereby, minimize liquid product slosh in the cartons as they are being transferred from station to station. Alternatively, the toothed rack 48 may be driven mechanically, such as by a cam, indexer, or geneva mechanism, represented as 48', machined to produce the required motion.

The gear 50 and a gear 55 are mounted on the same shaft 58. The gear 55 meshes with a gear 56 mounted on a shaft 60. The gears 55 and 56 mounted on the respective shafts 58 and 60 rotate pulleys or sprockets 61 for driving the two sides of the conveyor 12A carrying cartons C therebetween on the pull stroke of the rack 48.

The gear 52 is mounted on a shaft 62. A further gear 64 is also mounted on the shaft 62 and meshes with a still further gear 66. The latter gear 66 is mounted on a shaft 67 and meshes with a further gear 68 mounted on a shaft 69. The gears 66 and 68 mounted on the respective shafts 67 and 69 rotate pulleys or sprockets 70 for driving the two sides of the conveyor 14A, also carrying cartons C therebetween, on the push stroke of the rack 48. The one-way clutches 54 operatively connected to the gears 50 and 52, and their respective associated shafts 58 and 62 serve to asynchronously drive the conveyors 12A and 14A via the shafts 58/60 and 67/69 in one direction, depending upon the direction of movement of the rack 48.

As an alternate arrangement, as shown in FIG. 4A, the machine 10A may encompass having the rack 48 mesh directly with each of the gears 55 and 64, with a clutch 54 operatively connected to each of the gears 55, 56, 66 and 68 and their respective shafts 58, 60, 67 and 69.

An optional holding device 72 may be operatively connected to each of the gears 56 and 66 to maintain respective dwell or stop positions of the conveyors 12A and 14A.

INDUSTRIAL APPLICABILITY

It should be apparent that the invention provides a compact, efficient, and positively controlled arrangement for asynchronously driving dual indexing conveyors substantially 180 degrees out of phase with one another, for processing, for example, liquid-carrying cartons, thereby reducing the amount of peak power which would be required for a machine having simultaneously operating intermittently driven conveyors.

While four embodiments of the invention have been shown and described, other modifications thereof are possible within the scope of the following claims.

What is claimed is:

1. A machine for asynchronously driving a pair of indexing conveyors, said machine comprising an actuating source operatively connected to two gear sets mounted on respective shafts for asynchronously driving the pair of conveyors, a one-way clutch operatively connected to each gear set, and control means operatively connected to said actuating source for controlling the acceleration and deceleration of the conveyors from and toward each of its dwell or stop position.

2. The machine described in claim 1, wherein said actuating source is an intermittently actuating single reversible power source including gear means meshing with a selected gear of each gear set.

3. The machine described in claim 2, wherein one of said one-way clutches is operatively connected to each of said selected gears of each gear set.

4. The machine described in claim 3, wherein said control means is a servo controller programmed to use a parabolic curve or a cam emulation to minimize liquid product slosh in cartons being transferred by said conveyors.

5. The machine described in claim 1, wherein said actuating source is a uni-directional rotating driver, a rack, and linkage means therebetween for reciprocally moving the rack, and said rack being operatively connected to said two gear sets.

6. The machine described in claim 5, wherein said rack includes teeth formed on opposite sides thereof for meshing with a selected gear of each gear set.

7. The machine described in claim 6, wherein one of said one-way clutches is operatively connected to each of said selected gears of each gear set.

8. The machine described in claim 5, wherein said linkage means includes a crank arm secured to the uni-directional rotating driver, and a link connected between the crank arm and the rack.

9. A machine for asynchronously driving a pair of indexing conveyors, said machine including a single power source operatively connected to two gear sets mounted on respective shafts for asynchronously driving the pair of conveyors, and a one-way clutch operatively connected to each gear set, characterized by control means operatively connected to said single power source to provide controlled motion for said pair of conveyors during acceleration from and deceleration toward each dwell position of the respective conveyors.

10. The machine described in claim 9, wherein said single power source is a reversible servo motor and said control means is a servo controller adapted to provide the controlled motion for said pair of conveyors.

11. The machine described in claim 9, wherein said single power source is a uni-directional rotating driver means and an associated toothed rack providing the controlled motion for said pair of conveyors.

12. A machine for asynchronously driving a pair of indexing conveyors, said machine comprising an intermittently actuating single reversible power source operatively connected to two gear sets mounted on respective shafts for asynchronously driving the pair of conveyors, and a one-way clutch operatively connected to each gear set, wherein said intermittently actuating single reversible power source includes gear means meshing with a selected gear of each gear set, and wherein one of said one-way clutches is operatively connected to each of said selected gears of each gear set and their respective shafts, and reversible servo unit controller operatively connected to said power source and programmed to control acceleration from and deceleration into each dwell position of said conveyors.

13. A machine for asynchronously driving a pair of indexing conveyors, said machine comprising single uni-directional rotating driver operatively connected to two gear sets mounted on respective shafts for asynchronously driving the pair of conveyors, a one-way clutch operatively connected to each gear set, and linkage means connected between said uni-directional rotating driver and a rack for reciprocally moving the rack, said rack being operatively connected to said two gear sets, wherein said rack includes teeth formed on opposite sides thereof for meshing with a selected gear of each gear set, and wherein one of said one-way clutches is operatively connected to each of said selected gears of each gear set and their respective shafts.

14. The machine described in claim 12, wherein each of said two gear sets includes a pair of intermeshing gears mounted on respective shafts driving one of said pair of conveyors, with one of said pair of intermeshing gears mounted on the shaft of said selected gear.

15. The machine described in claim 12, wherein each said selected gear meshes with a second gear of said gear set, said selected gear and said second gear mounted on respective shafts driving one of said pair of conveyors, and a one-way clutch is operatively connected to each of said selected gear and said second gear of each gear set.

16. The machine described in claim 13, wherein each gear set includes a pair of intermeshing gears mounted on respective shafts driving one of said pair of conveyors, with one of said gear sets having one of said pair mounted on the shaft of said selected gear, and the other of said gear sets includes said selected gear and a further gear mounted on a separate shaft, and said further gear meshes with one of said pair of intermeshing gears.

17. The machine described in claim 13, wherein said selected gear of one gear set meshes with a second gear of said one gear set, said selected gear and said second gear mounted on respective shafts driving one of said pair of conveyors, and said selected gear of the other gear set meshes with one of a pair of intermeshing gears mounted on respective shafts for driving the other of said pair of conveyors, and a one-way clutch is operatively connected to each of said selected gear of said one gear set and said second gear, and to each of said pair of intermeshing gears.

18. Apparatus comprising first and second indexing conveyors, a continually reversing drive member, and first and second connecting means connecting said drive member to the respective conveyors in a manner which does not drive the conveyors backwards, wherein the improvement comprises control means arranged to control the speed of said drive member in one sense and an opposite sense throughout substantially the whole of each decelerating movement and each accelerating movement of said drive member into and out of each dwell position of said drive member.

19. Apparatus comprising first and second indexing conveyors, a continually reversing drive member, and first and second connecting means connecting said drive member to the respective conveyors in a manner which does not drive the conveyors backwards, wherein the improvement comprises said first and second connecting means including first and second toothed elements, respectively, and said drive member comprising a third toothed element in driving connection with said first and second toothed elements.

20. A method comprising providing first and second indexing conveyors, a drive member, and first and second connecting means connecting said drive member to the respective conveyors, continually reversing said drive member so as to drive the conveyors alternately through said first and second connecting means in a manner which does not drive the conveyors backwards, wherein the improvement comprises controlling the speed of said drive member in one sense and an opposite sense throughout substantially the whole of each decelerating movement and each accelerating movement of said drive member into and out of each dwell position of the drive member.

21. The method described in claim 20, and further controlling the speed of said drive member throughout substantially the whole of each cycle of movement of the drive member.

* * * * *